US005117508A

United States Patent [19]

Gunter, Tod D.

[11] Patent Number: 5,117,508

[45] Date of Patent: Jun. 2, 1992

[54] SYSTEM FOR ATTACHING A DISPLAY UNIT TO A GLOVE

[76] Inventor: Gunter, Tod D., R.D. #1, Box 3080, Bristol, Vt. 05443

[21] Appl. No.: 538,110

[22] Filed: Jun. 14, 1990

[51] Int. Cl.[5] ..... A41D 19/00

[52] U.S. Cl. ..... 2/160

[58] Field of Search ..... 2/160, 161 A, DIG. 6; 224/903; 24/265 B, 906

[56] References Cited

U.S. PATENT DOCUMENTS

| | | | |
|---|---|---|---|
| 1,309,150 | 7/1919 | Munfort | 2/160 |
| 1,524,137 | 1/1925 | Kastl et al. | 2/160 |
| 2,333,428 | 11/1943 | Kinsey | 2/160 X |
| 3,847,110 | 11/1974 | Inoue | 2/161 A X |
| 4,387,838 | 6/1983 | Jackson | 224/170 |
| 4,489,444 | 12/1984 | Graham | 2/160 |
| 4,761,835 | 8/1988 | Chen | 2/160 |
| 4,766,611 | 8/1988 | Kim | 2/160 |
| 4,862,521 | 9/1989 | Mann | 2/160 |
| 5,003,637 | 4/1991 | Lonon | 2/160 |

FOREIGN PATENT DOCUMENTS 14122 of 1905 United Kingdom ..... 2/160

*Primary Examiner*—Werner H. Schroeder
*Assistant Examiner*—Sara M. Current
*Attorney, Agent, or Firm*—Cohen, Pontani, Lieberman & Pavane

[57] ABSTRACT

A display unit is attached to a fastening band of a glove; the fastening band including a top strap and a bottom strap for underlying the top strap, with confronting surfaces of the top and bottom straps comprising cooperating interengaging regions, such as Velcro fabric, for example. The attaching system includes a first strap portion extending from the display unit and having an end region for insertion between the top and bottom straps of the glove and beneath the display unit. Such end region has on top and bottom surfaces respective interengaging regions for respectively interengaging with the mentioned interengaging regions of the top and bottom glove straps. A second strap portion extends from an opposite side of the display unit and away from the display unit. A tack securing arrangement secures the second strap portion to the glove.

9 Claims, 2 Drawing Sheets

SYSTEM FOR ATTACHING A DISPLAY UNIT TO A GLOVE

BACKGROUND AND SUMMARY OF THE INVENTION

The present invention relates to a system for attaching a display device to a glove, especially a sports glove.

Gloves used for sporting activities, such as bicycling gloves, frequently include a fastening band comprised of top and bottom straps having confronting surfaces; such top and bottom straps typically being held together by the use of fabric hooks on one of the confronting surfaces, and fabric loops on another of such surfaces. Such fabric hooks and loops are currently available under the trademark Velcro. The fastening band typically comprises a wristband.

It would be desirable to provide a system for attaching a display device, such as a watch, to a fastening band of glove. This would avoid the necessity of using a separate fastening band for the display device, which would avoid drawbacks associated with an additional fastening band, such as inducing perspiration of the user's wrist and causing so-called "tan-lines" on the user's wrist from uneven exposure to the sun.

It would further be desirable to provide such an attaching system for a display unit that allows the display unit to be held on the glove in a customary viewing position.

It would also be desirable to provide an attaching system of the mentioned type that is of simple construction.

The foregoing objects are realized by the present invention in a system for attaching a display unit to a fastening band of a glove. The fastening band includes a top strap, and a bottom strap for underlying the top strap. Confronting surfaces of the top and bottom straps comprise cooperating interengaging means, such as hooks and loops of Velcro fabric. The system comprises a first strap portion extending from the display unit and having an end region for insertion between the mentioned top and bottom straps of the glove and beneath the display unit. Such end region has on top and bottom surfaces respective interengaging means for respectively interengaging with the mentioned interengaging means of the top and bottom glove straps. A second strap portion extends from an opposite side of the display unit, away from the display unit. A tack securing means is provided for securing the second strap portion to the glove.

BRIEF DESCRIPTION OF THE DRAWING FIGURES

The foregoing and further objects of the invention will become apparent from reading the following detailed description of preferred embodiments of the invention, in which.

DETAILED DESCRIPTION OF THE PRESENTLY PREFERRED EMBODIMENTS

Figure 1:
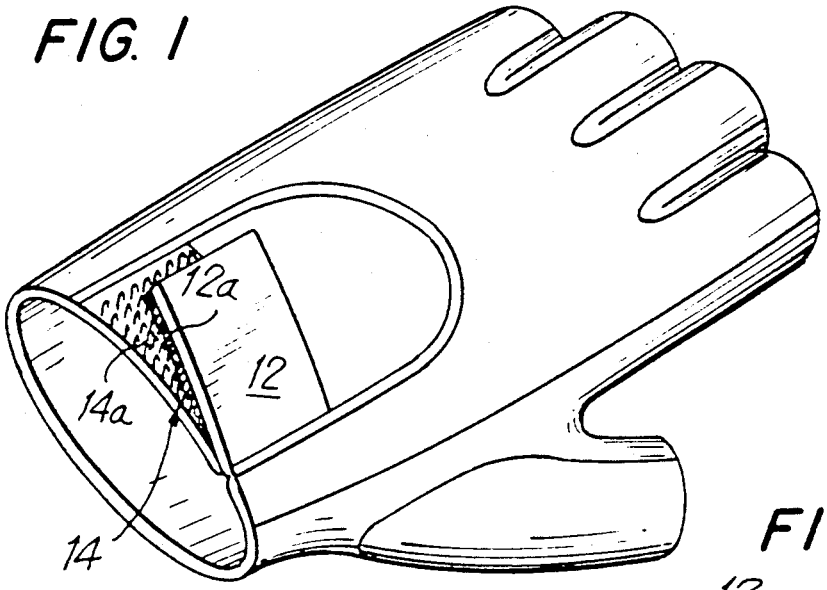
FIG. 1 is a perspective view of a typical sports glove upon which a display device can be mounted in accordance with the invention.
Figure 1A:
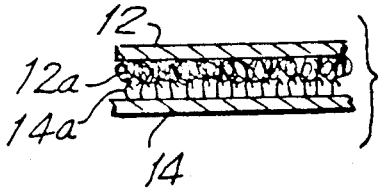
FIG. 1A is a detailed view of a fabric hook and fabric loop interengaging means mounted on confronting surfaces of top and bottom straps 12 and 14 of FIG. 1.

FIG. 1 shows a typical athletic glove 10 with which the present attaching system for a display unit can be used. The glove 10 includes a two-part wristband 12, 14, which includes on respective confronting surfaces interengaging means 12*a* and 14*a* (better seen in FIG. 1A). The interengaging means 12*a* preferably comprises a plurality of flexible fiber loops that are engaged by respective fiber hooks 14*a* of the interengaging means on the bottom strap 14. Such an interengaging system is currently marketed as Velcro fabric. Interengaging means 14*a*, as shown in FIG. 1, is comprised of fabric hooks on a common backing that, in turn, is connected to a strap (here, the bottom strap 14); this construction is preferably used for the other interengaging means described herein, although not specifically mentioned.

Figure 2:
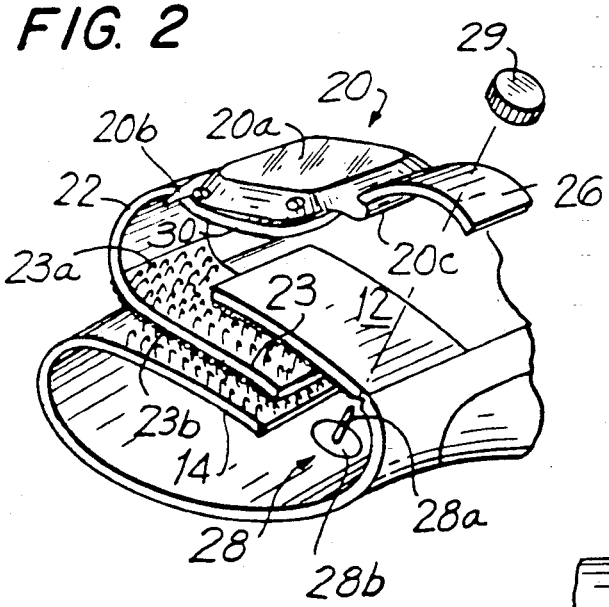
FIG. 2 is a partial exploded view of the glove of FIG. 1 together with a display device and system for attaching such display device to the glove.

FIG. 2 illustrates how a display unit 20, such as a watch, can be conveniently connected to the sports glove 10. A first strap portion 22 of nylon web, for example, extends from the display unit 20 and has a end region 23 for insertion between the top 12 and bottom 14 straps of the glove, with such end region 23 then being positioned beneath the display unit 20.

The free end region 23 has on top and bottom surfaces respective interengaging means 23*a* and 23*b* for respectively interengaging with the interengaging means 12*a* and 14*a* (FIG. 1A) of the top and bottom glove straps 12 and 14. Interengaging means 23*a* is preferably comprised of hooks, and interengaging means 23*b*, of loops, of Velcro fabric.

In FIG. 2, a second strap portion 26 extends away from the display unit 20, in the opposite direction from the first strap portion 22. The second strap portion 26 is attached to the glove 10 with the aid of a tack 28, of an externally threaded stainless steel construction, for instance, and a cooperating generally flat retaining button 29, of an internally threaded nylon construction, for instance. A threaded cylindrical shaft 28*a* of the tack 28 is preferably used to pierce, if necessary, and extend upwardly through the top glove strap 12 and then through the second strap portion 26, so as to provide a threaded surface for mating with the retaining button 29.

In the foregoing construction, a generally flat member 28*b* of the tack 28 is positioned on the underside of the top glove strap 12. It may, alternatively, be desirable for the cylindrical member 28*a* of the tack 28 to extend through a portion of the glove 10 adjacent the top glove strap 12. The use of a glove 10 with preexisting ventilation holes through its main fabric would lend itself to such alternative construction.

In FIG. 2, the display device 20 includes, on opposite sides of a main body 20*a*, respective pins 20*b* and 20*c*. The first and second strap portions 22 and 26 are integrally joined to each other, in the FIG. 2 version, to form a single strap that is looped from adjoining portion 30, beneath the display device, respectively over each of the pins 20*b* and 20*c*.

Figure 3:
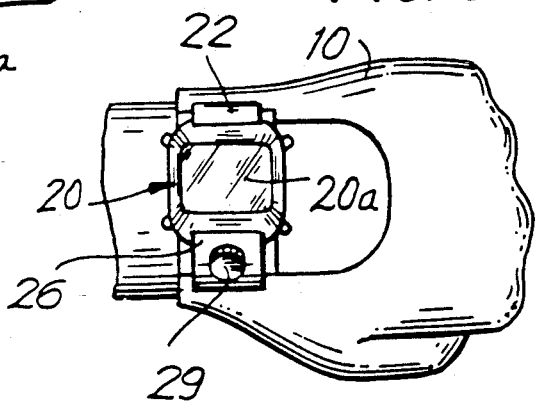
FIG. 3 is a simplified plan view of the glove and display unit of FIG. 2 in assembled form, with the glove placed on the hand of a user.

FIG. 3 shows the display unit 20 as mounted on glove 10, with the hand of a user within the glove. After the retaining button 29 has been secured to the tack 28, the positioning of the display unit 20 and its associated first and second strap portions 22 and 26 relative to the glove 10 are as shown in FIG. 2. In such position, the second strap portion 26 rests atop the top glove strap 12.

Figure 4:
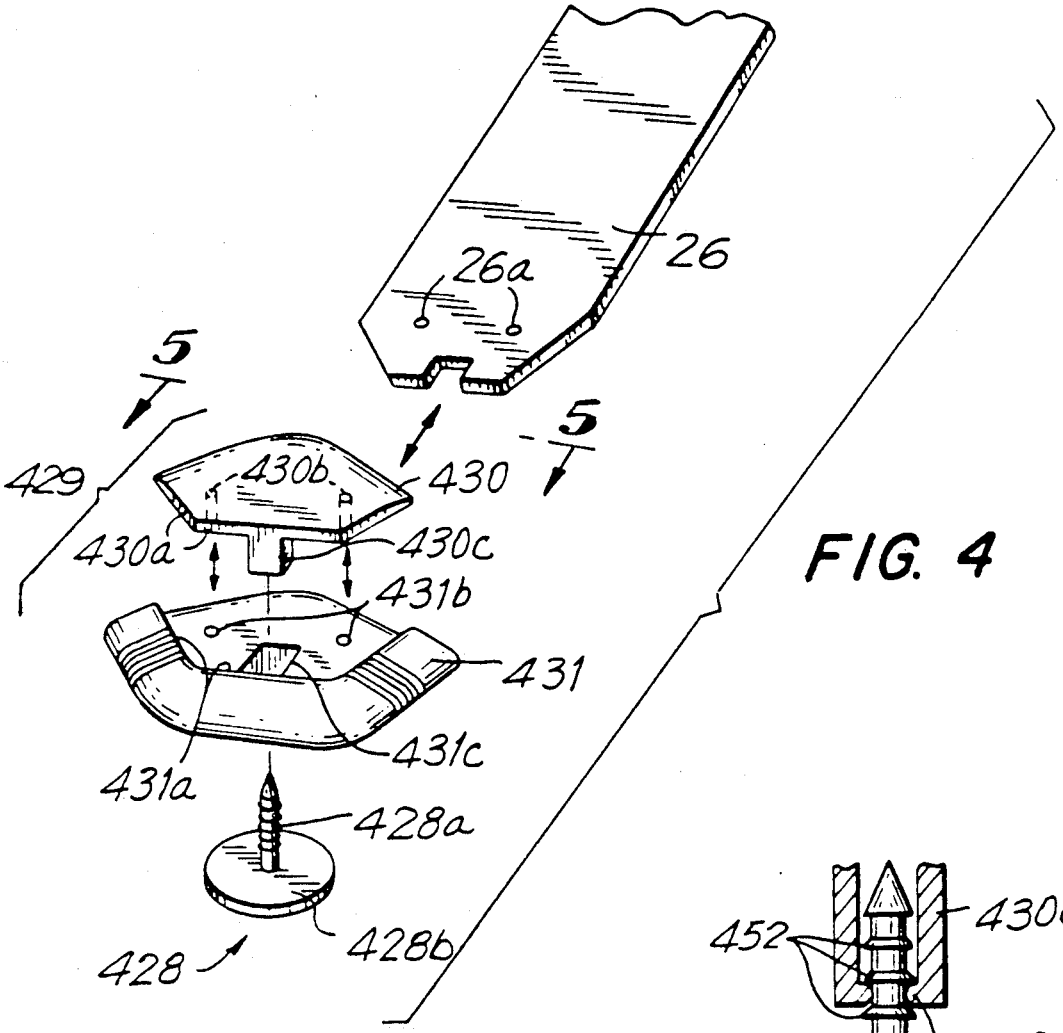
FIG. 4 is an exploded view of an alternative to the tack 28 and retaining button 29 of FIG. 1, in which the second band portion is secured between upper and lower strap-retaining members.

FIG. 4 shows an exploded view of a preferred retaining member 429 that cooperates with a tack 428 for securing the second strap portion 26 to a glove. The tack 428 is preferably formed of material trademarked under the term Lexan, for instance, although it could comprise other material such as stainless steel. The retaining member 429 includes upper and lower strap-retaining members 430 and 431, respectively, for receiving between them the illustrated free end of the second strap portion 26. Such members 430 and 431 may be formed of molded plastic, for example. A lateral wall surface 430*a*, extending away from the display device (not shown), abuts against a corresponding ridge 431*a* in the lower strap-retaining member 431. Downwardly pointing projections 430*b* of the upper member 430 may be received within corresponding apertures 431*b* in the lower member 431, via apertures 26*a* in the second strap 26.

Figure 4A:
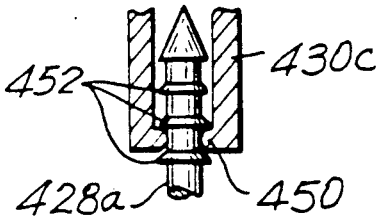
FIG. 4A is a detailed view of a receptor in which a cylindrical portion of a tack is held.

The upper strap-retaining member 430 includes a downwardly projecting receptor 430*c* for receiving the cylindrical portion 428*a* of the tack 428. FIG. 4A shows, specifically, how receptor 430*c* includes a narrowed engaging region 450 for engaging beneath one of a plurality of ribs 452 extending outwardly from a cylindrical surface of the cylindrical member 428*a*.

Figure 5:
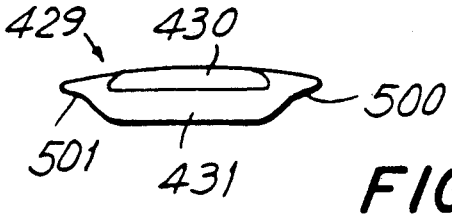
FIG. 5 is a simplified plan view taken at arrows 5, 5 in FIG. 4 and showing a preferred contour of a lower strap-retaining member shown in FIG. 4.

FIG. 5 shows a simplified view of the retaining member 429 taken at arrows 5, 5 in FIG. 4. The strap 26 is omitted for clarity. The sides of the lower strap-retaining member 431 are scalloped as shown at 500 and 501 to facilitate gripping of the retaining member 429 when removing it from the tack 428 (FIG. 4).

The foregoing describes a system for attaching a display unit to a fastening band of a glove, which allows the display device to be held in a customary viewing position without the need for a separate fastening band.

It should be understood that the preferred embodiments and examples described are for illustrative purposes only and are not to be construed as limiting the scope of the present invention which is properly delineated only in the appended claims.

What is claimed is:

1. In combination:

a bicycling glove for removable receipt over at least a portion of a user's hand which is movably connected to an elongated arm of the user, said glove including a normally open rear portion for receipt about the user's hand proximate said connection of the hand to the arm and said rear portion including engageable means for substantially closing said glove rear portion and thereby releasably securing said glove about the user's hand, said engageable means comprising a first part unitary with said glove and a second part unitary with said glove and defining an elongated closure strap extending substantially transverse to said arm elongation for user-effected placement into selectively overlayed relation with said first part to substantially close said rear portion, each of said first and second parts having a surface disposed in mutually confronting relation with each other and carrying first hook-and-loop means for releasable position-retaining cooperative engagement of said first and second parts when said second part is moved into selectively overlayed relation with said first part so as to substantially close said rear portion and thereby secure said glove about the user's hand; and attachment means for releasably attaching a display unit to said glove, the display unit having an information-bearing face and a top and a bottom defining a viewing orientation in which information borne on the face of the display unit is viewable by the user, said attachment means comprising:

a first elongated display strap extending outwardly from the top of the display unit and having an end region remote from the top of the display unit, said end region having oppositely-disposed faces and being insertable between said first and second glove parts with the elongation of said first display strap and of said second glove part extending in substantially parallel relation, each of said faces carrying second hook-and-loop means for releasable cooperative engagement with said first hook-and-loop means of a respective one of said first and second parts to thereby releasably secure said first strap end region between said first and second glove parts without interfering with said releasable position-retaining engagement of said first and second parts when said second part is moved into selectively overlayed relation with said first part so as to substantially close said rear portion and thereby secure said glove about the user's hand, said first display strap further comprising a bendable region intermediate said end region and the top of the display unit.

a second elongated display strap extending outwardly from the bottom of the display unit; and tack means for releasable engagement of said second elongated display strap to said glove rear portion when the display unit is disposed on said glove with said viewing orientation substantially transverse to the elongation of the user's arm for ease of viewing by the user, said tack means including projecting means for extension through said second display strap and through said glove to secure said second strap to the glove with said first display strap bendable region being folded, when said first strap end region is inserted between said first and second glove parts, in sandwiching relation about said glove second part such that all of said first strap extends substantially parallel to said first strap end region elongation so that the information-bearing face of the display unit is disposed in outwardly-facing relation from said glove and in proper orientation for ready viewing by the user with the elongations of said first and second display straps extending substantially transverse to the elongation of the user's arm.

2. In the combination claim 1, said glove being formed of a material of construction and said tack means comprising a tack including a generally flat head member joined to said projecting means, said projecting means comprising an elongated shaft-like member having a free end remote from said flat member for projection through said second display s trap and through the material of the glove, said tack means further comprising a generally flat retaining member engageable with said projecting means for retaining said elongated member in projecting relation through said second display strap and through said glove to secure said second strap to the glove.

3. In the combination of claim 2, said second display strap having a free end portion remote from the bottom of the display unit, and said generally flat retaining member comprising mutually interengageable upper and lower strap-retaining members for receiving and cooperatively retaining therebetween the free end portion of said second display strap, said upper retaining member including a receptor for receiving said elongated shaft-like member of said tack means.

4. In the combination of claim 3, wherein said elongated shaft-like member carries, along at least a portion of its length, a plurality of ribs, said receptor including means for engaging said ribs to facilitate retention of said shaft-like member with said receptor.

5. In the combination of claim 3, said free end portion of said second display strap including positioning means cooperable with at least one of said upper and lower retaining members for positional retention of said second display strap by said generally flat retaining member so as to prevent unintended displacement and disengagement of said second display strap from said generally flat retaining member.

6. In the combination of claim 5, said positioning means comprising a cutout defined in said free end portion of the second display strap, said cutout being sized and contoured for receiving at least a portion of said receptor of said upper retaining member.

7. In the combination of claim 3, said lower retaining member including a recess for receiving said receptor of the upper retaining member.

8. In the combination of claim 1, said projecting means of said tack means securing said second display strap to the glove by extending through said second strap and through said glove second part to thereby secure said second strap to the glove.

9. In the combination of claim 1, said first and second straps being connected one to the other to define a single elongated, unitary band along which the position of said display unit is selectively adjustable by the user.

* * * * *